US005678468A

United States Patent [19]

Lozano Bonet et al.

[11] Patent Number: 5,678,468

[45] Date of Patent: Oct. 21, 1997

[54] LATERAL PUNCHING UNIT

[76] Inventors: José Lozano Bonet; Alfredo Lozano Bonet, both of Mijares, 16—bajo, Valencia, Spain, 46011

[21] Appl. No.: 505,177

[22] PCT Filed: Dec. 7, 1994

[86] PCT No.: PCT/ES94/00133

§ 371 Date: Aug. 11, 1995

§ 102(e) Date: Aug. 11, 1995

[87] PCT Pub. No.: WO95/16527

PCT Pub. Date: Jun. 22, 1995

[30] Foreign Application Priority Data

Dec. 13, 1993 [ES] Spain ..... 9302569

[51] Int. Cl.[6] ..... B26D 1/06; B26D 5/00

[52] U.S. Cl. ..... 83/588; 83/627; 83/590; 83/824; 83/635; 83/684; 384/42; 384/907.1

[58] Field of Search ..... 83/627, 62, 588, 83/590, 824, 613, 194, 623, 635, 684, 679, 699.51, 699.31; 384/907, 907.1, 42; 30/358, 361, 362

[56] References Cited

U.S. PATENT DOCUMENTS

| | | | |
|---|---|---|---|
| 1,520,749 | 12/1924 | Brownrigg | 384/907.1 X |
| 2,859,261 | 11/1958 | Arbeit | 384/907.1 X |
| 3,473,425 | 10/1969 | Foist et al. | 83/129 |
| 3,541,909 | 11/1970 | Franzen | 83/588 |
| 3,711,171 | 1/1973 | Orkin et al. | 384/907.1 X |
| 3,878,745 | 4/1975 | Handziak et al. | 83/61 X |
| 4,471,680 | 9/1984 | Gerhart | 83/627 X |
| 4,621,512 | 11/1986 | Tachikawa et al. | 72/325 X |
| 5,007,282 | 4/1991 | Bakermans | 83/698.91 X |
| 5,099,708 | 3/1992 | Chung | 83/635 X |
| 5,101,705 | 4/1992 | Matsuoka | 83/588 |
| 5,146,832 | 9/1992 | Wilson et al. | 83/698.91 X |
| 5,181,438 | 1/1993 | Wellman | 83/698.91 X |

FOREIGN PATENT DOCUMENTS

| | | | |
|---|---|---|---|
| 3241002 | 5/1984 | Germany | 384/907 |
| 0053316 | 3/1988 | Japan | 384/907 |
| 1065326 | 3/1989 | Japan | 384/907 |
| 0017219 | 1/1990 | Japan | 384/907 |
| 001739105 | 6/1992 | U.S.S.R. | 384/907 |

OTHER PUBLICATIONS

For high pressures, low velocities . . . Bonded Coatings Lubricate Metal Parts by Alfred Disapio in Product Engineering on Sep. 5, 1960.

*Primary Examiner*—Rinaldi I. Rada
*Assistant Examiner*—Boyer Ashley
*Attorney, Agent, or Firm*—Richard M. Goldberg

[57] ABSTRACT

The disclosed punching unit transforms the vertical motion of a press into a horizontal punching motion by means of two wedges inside the unit body, the down motion of the upper wedge determining the horizontal displacement of the lower wedge, the unit being provided with a return mechanism and with a locking sensor for stopping the unit. It has gas dampers or metal springs, and in one embodiment, the unit is mounted on a base plate which is larger than the plant, and which is aligned with the clamping plate, thereby providing anti-rotation in collaboration with the internal anti-rotation structure.

18 Claims, 5 Drawing Sheets

LATERAL PUNCHING UNIT

BACKGROUND OF THE INVENTION

The sector which this patent's technique comes under is that of punching tools driven by presses.

Statement of the prior state of the art. There are already certain kinds of punching devices of the type that transfer a vertical movement into a horizontal punching effect; one of the standard types known of is made up of a base which holds the punch and the die, which has a set of two wheels on an axle, the upper wheel being driven by the press and the lower one consequently punching the horizontal body of the punch holder, which can have a gas cylinder for transmission for the horizontal movement.

ES U9103566 discloses a "improved device for driving the striker in punching machine tools" made up of a "U" shaped piece or chassis set horizontally, which includes a vertically moveable striker and a dual effect fluid plunger which determines the stroke of the striking part by means of fluid-dynamic transmission. This is a classic arrangement and the transmission of the movement is made in the same direction as this is received by the striking unit.

ES U237 261 for an "improved punching unit" which is prior to the device already mentioned and has very similar characteristics as regards its structure and operation.

The aim of this invention is to provide a lateral punching unit made up of a set of parts which are designed to transmit a punching movement 90° from the direction in which the pressure or the corresponding press stroke is exerted its main advantage lies in its simplicity, its small size, stemming from the type of alignment involved in the wedge and its anti-rotation system, features which enable errors in the return stroke to be detected and thus prevent the press from making a further stroke on the upper piston, apart from the efficient transmission of the vertical movement into horizontal movement. These parts are furthermore substantially economical to make.

This is made up of a body which constitutes the support for the whole assembly, which has substantially two moving parts: one which moves vertically, and the other which moves in a horizontal direction both connected so that the vertical one grips the horizontal one, preventing any possible turning torque arising in the second one.

BRIEF DESCRIPTION OF THE DRAWINGS

In order to made the following explanation clearer, five sheets of drawings are enclosed, which represent the essence of this invention in ten figures. The first five of these represent one particular embodiment, and the five following ones are of another embodiment made in the same way and with the same essence, for stronger unit.

On possible embodiment is represented in the following figures.

Figure 6:
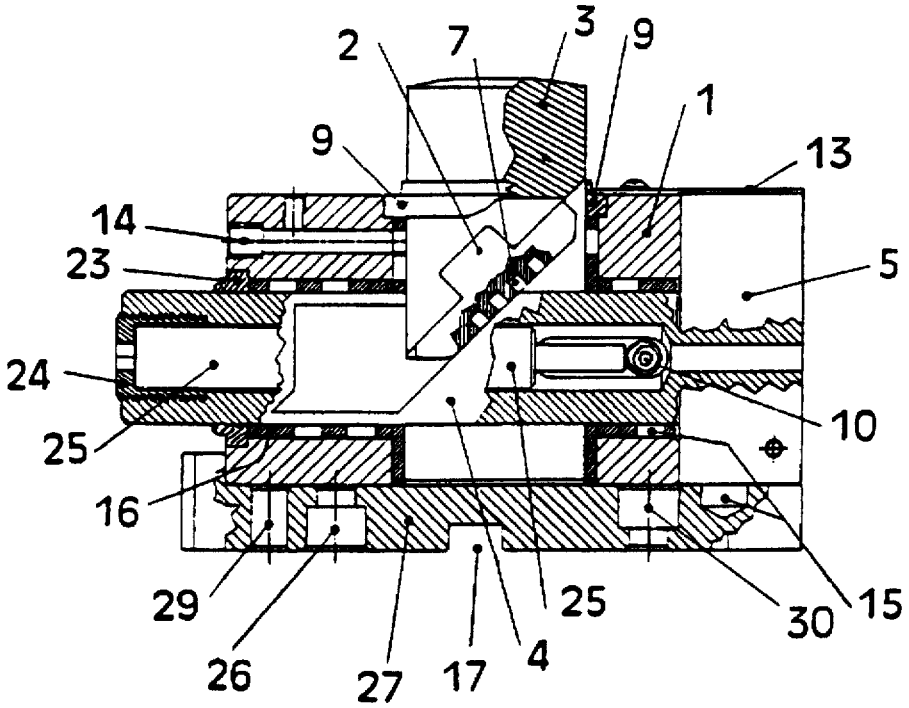

FIG. 6 shows a longitudinal section of the part ready to start punching.

Figure 7:
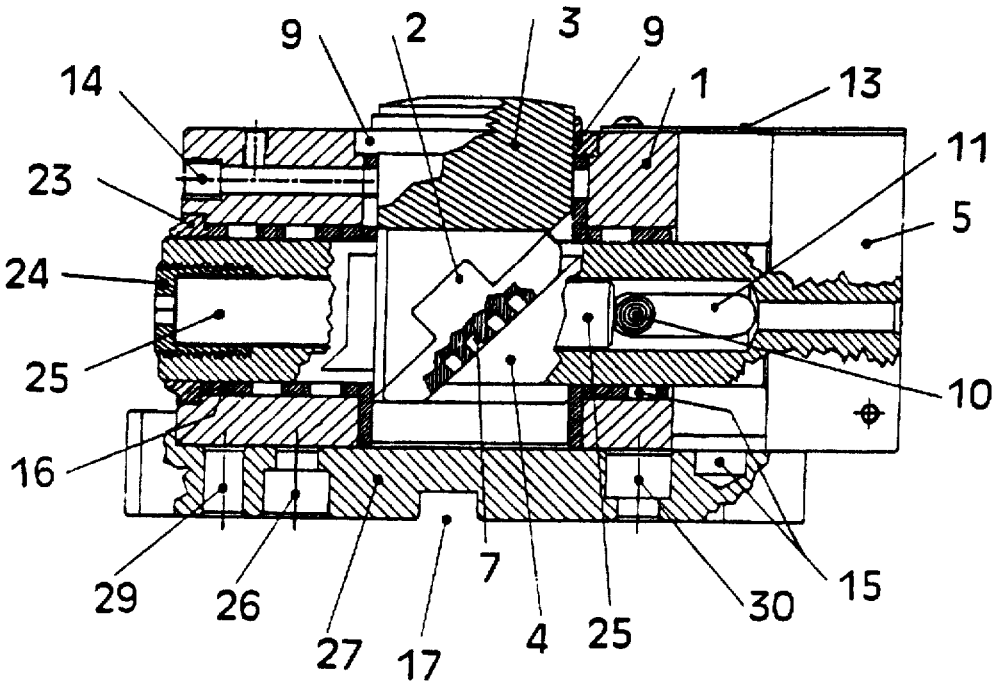

FIG. 7 shows a longitudinal section of the part just as the piston has been lowered.

Figure 8:
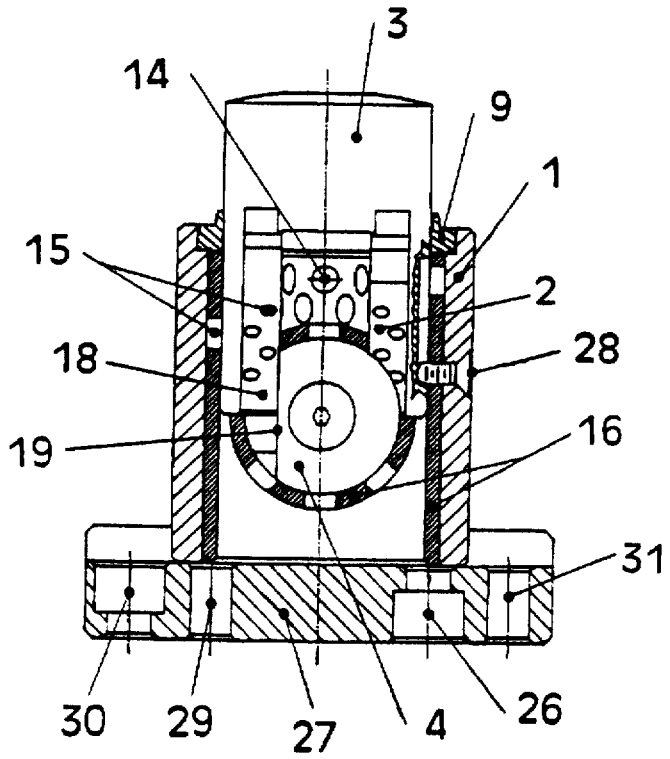

FIG. 8 shows a cross section view in accordance with FIG. 6.

Figure 9:
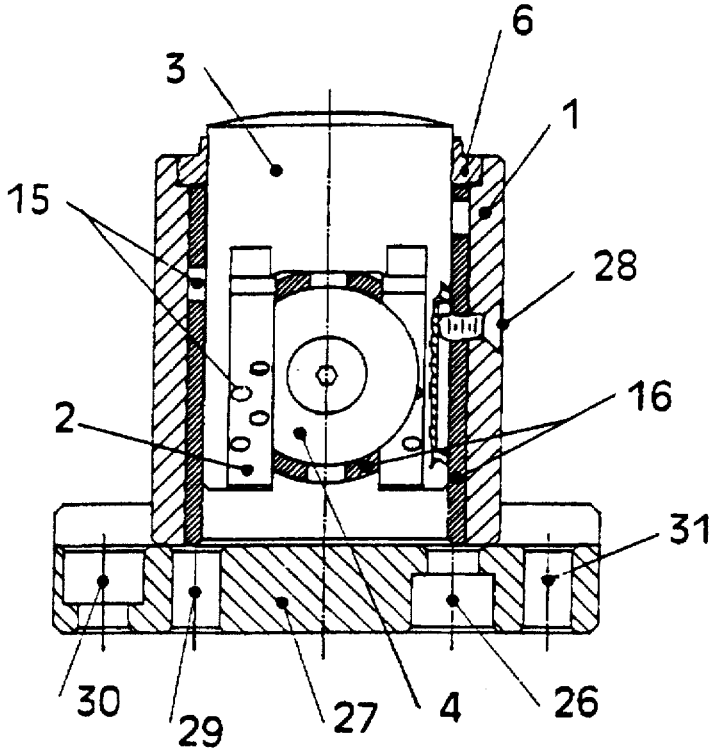

FIG. 9 shows a cross section view in accordance with FIG. 7.

Figure 10:
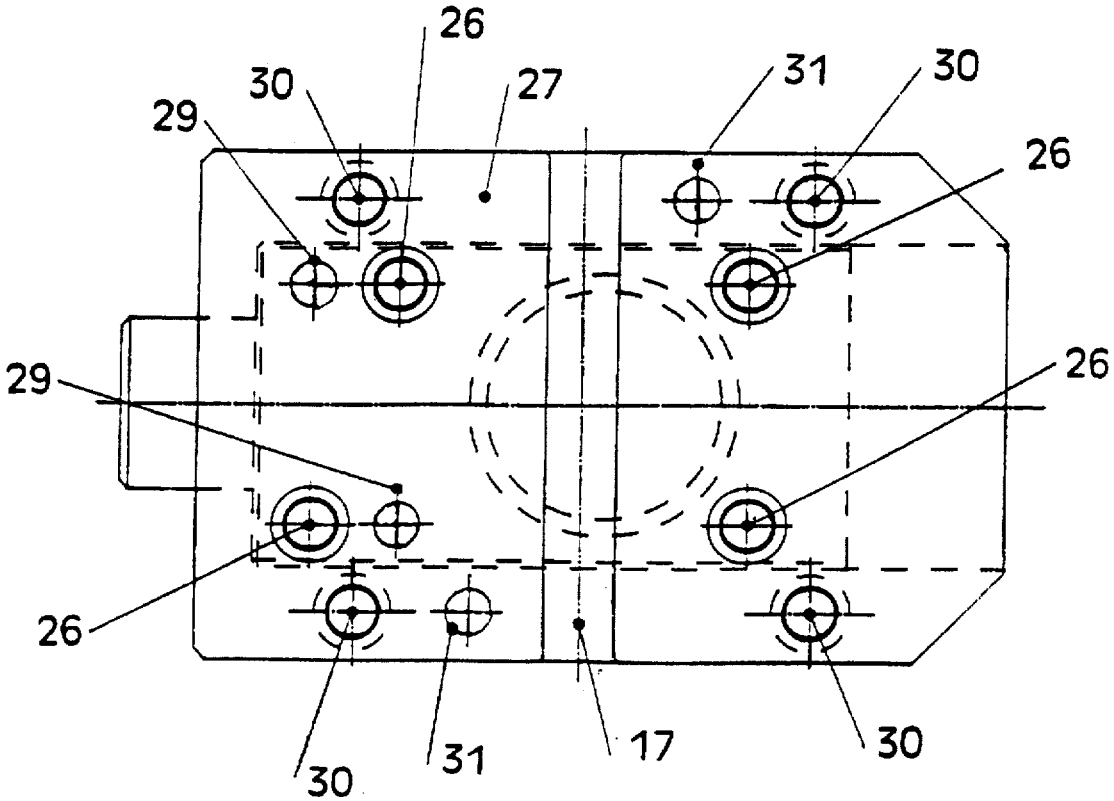

FIG. 10 shows a lower view of the item, that is, as seen from below.

DESCRIPTION OF THE PREFERRED EMBODIMENTS

Figure 1:
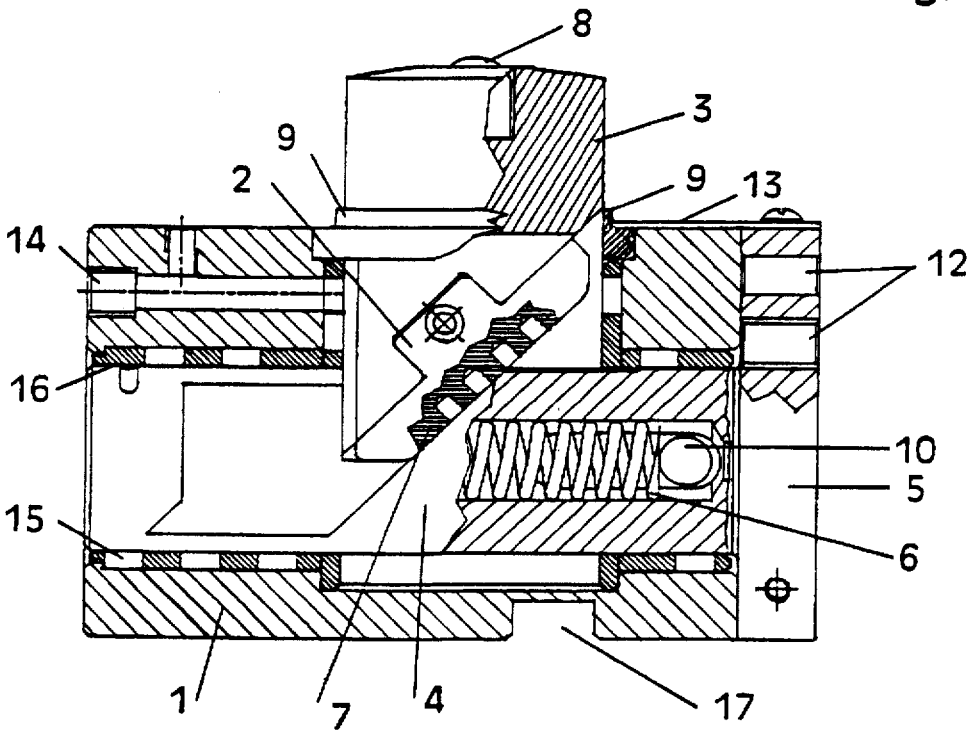
FIG. 1 shows a longitudinal section of the item ready to start punching.
Figure 2:
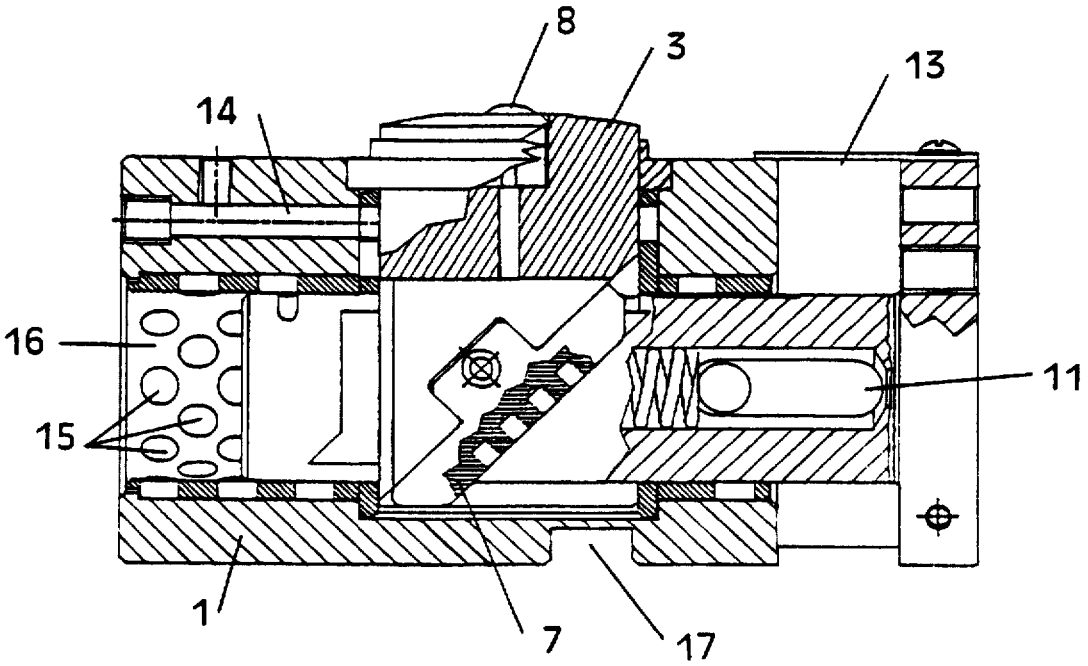
FIG. 2 shows a longitudinal section of the item just as the piston has been lowered.
Figure 3:
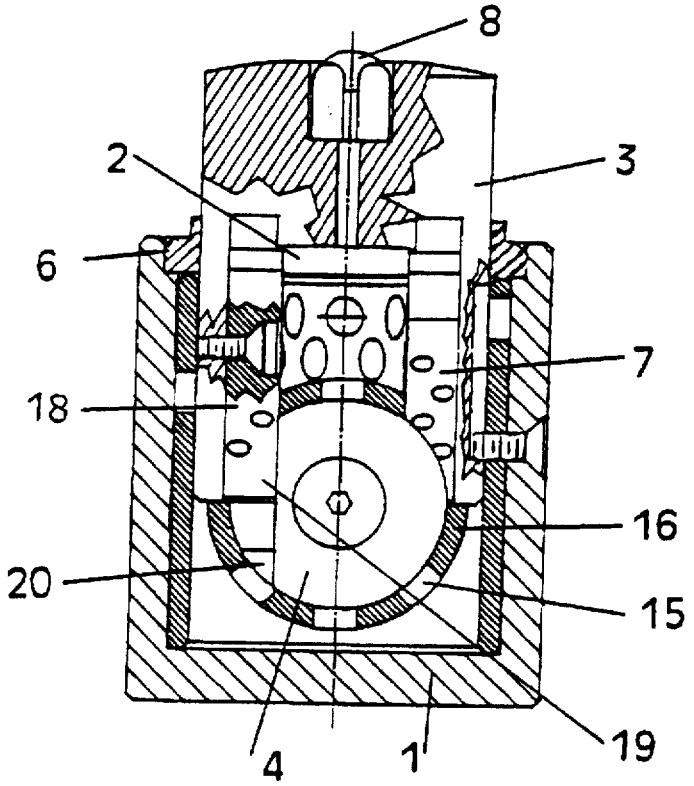
FIG. 3 shows a cross section in accordance with FIG. 1.
Figure 4:
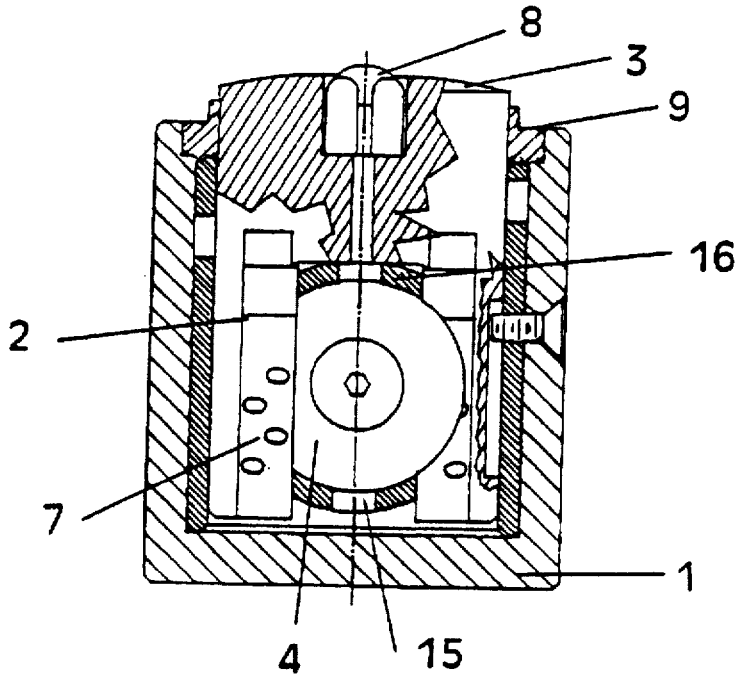
FIG. 4 shows a cross section view in accordance with FIG. 2.
Figure 5:
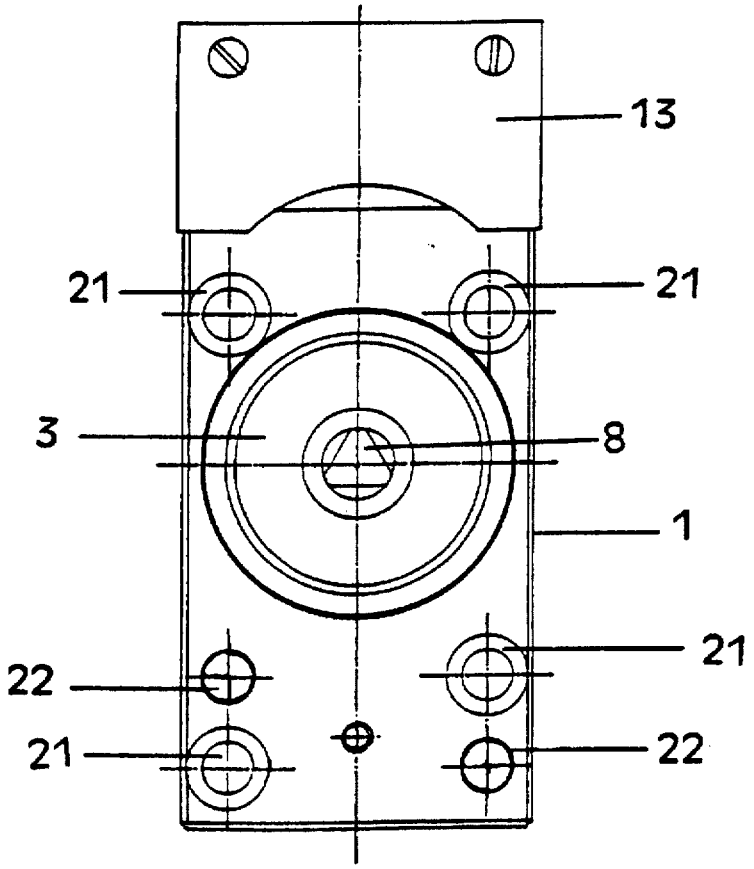
FIG. 5 shows a top view of the piece.

In these FIG. 1 indicates the supporting body, 2 the upper wedge, with 3 being the upper piston, 4 the lower wedge, 5 the anchorage plate or front part for clamping the punch, 6 the return spring, and 7 the plate, one of whose characteristics is that of having a low friction coefficient which withstands high pressures, and can be provided with lubricant, for example graphite, 8 being the silencing stop. 9 are the piston scrapers, 10 is the inner cross-piece, 11 the slot in the body of the lower wedge, 12 the anchorage holes for the punch holder, 13 the plate that covers the space or hole which generates the movement of the lower wedge 4, 14 being the hole for the proximity detector, 15 the lubricating plates, and 16 the anti-friction bushes, for example made of self-lubricating or non self-lubricating bronze 17 is the slot for securing to the working base, 18 the part of the upper wedge which goes into the lower wedge by means of its vertical movement, and 19 the part of the lower wedge which goes into the upper wedge. 20 shows the lower profile of the lower wedge as the upper wedge affects this, and 21 the anchorage holes of the assembly which go right through, as shown in FIG. 5, with 22 representing the alignment holes.

The embodiment as shown in FIGS. 6 to 10 has slight modifications which are represented as 23 for the lower wedge scraper, 24 being the gas spring securing cover, 25 being the gas spring itself, and 26 the holes for securing the body to the base plate. 27 is the base plate or second anti-rotation device, 28 being the screw for limiting the stroke of piston 3, 29 the hole for aligning the supporting body to the base plate, 30 the hole for anchorage to the base plate, and 31 the alignment hole on the base plate.

This invention works in the following way: the support body 1 is formed of a structure that can be fixed onto the working surface, and has an upper wedge 2, an upper piston 3 and, connected to said upper wedge, a lower wedge 4 which has a frontal clamping part for the punch holder or anchorage plate indicated as 5, which returns through the effect of a spring 6, with the support of said spring being on one side a cross-piece 10 and on the opposite side the lower wedge 4 itself. The upper wedge 2, has an inner section in contact with the lower wedge 4 made up of a lubricating plate 7 with graphite inlays, with the oblique surface of the wedge 4 which touches this being smooth. The upper piston 3 has a stop 8 made of rubber, polyurethane or similar material, to reduce the noise made and tis upper piston is set between scrapers 9. The return spring for the front part is fixed to an inner cross-piece 10 secured to the support body, the body of the lower wedge 4 thus being provided with a slot 11 to let said cross-piece 10 through. The front part 5 has holes 12 for securing the punch holder, and its perimeter is covered by a plate 13 which covers the hole generating the movement of the lower wedge 4, up to the scraper 9. The rear part has a hole with a proximity detector shown as 14, whose function is to detect whether the corresponding return movement does not take place after the stroke and, if not it sends a signal which the results in locking of press movement. The inside of the body 1 has lubricating plates 15, and bronze bushings 16. The upper 2 and lower 4 wedges are locked together by part 2 having a "U" shape which surrounds the other so that it prevents any possible turning torque. The anti-rotation device of the lower wedge 4 is made up by the coplanar shape of parts 18, 19 and 20 which fit in such a way as to prevent said lower wedge 4 from turning. Securing for work operations is done by means of the through holes 21 and 22 described in FIG. 5.

The embodiment shown in FIGS. 6 to 10 includes an additional anti-rotation mechanism, since the possible and necessary clearance between parts 4 and 3 might produce a misalignment after many work sessions due to the tendency to turn, and thus a separate structure, separated between the body 1 and the base plate 27, has been envisaged for heavier duty units. For this purpose two types of alignment have been designed; the first one on the supporting plate in respect of the working surface, provided not only by means of the securing slot 17, but also by the alignment holes in the base plate 31 and the holes for anchoring the base plate 30; and a second one in which the body 1 and the base plate 27 are adjusted by means of the holes for aligning the support body to the base plate 27 and fixed by means of the anchorage holes in the support body to the base plate 27. The anti-rotation system between wedge 4 and piston 3 of the piece is brought about between the clamping plate for punch holders 5 and the base plate 27, which, as we have already described, sticks out from the vertical projection of the unit, and which constitutes the second anti-rotation mechanism. The lower end of the plate 5 therefore fits, as can be seen in FIGS. 6 and 7, with the base plate, sliding as it moves forward over this, which is smooth, and thus relieving the inner anti-rotation device of part of its work, extending the unit's useful life.

In this embodiment, spring 25 is gas powered, this being more efficient for return movement, due to the part's small size and the fragile nature of metal springs. Here too on the lower wedge a scraper 23 is provided on the rear part, slightly extended, which is in order to prevent dirt from getting in when wedge 4 moves during its operation.

This is for industrial application in punching machines.

We claim:

1. Lateral punching unit comprising:

a support body, an upper wedge mounted on said support body for movement only in a first direction, said upper wedge have a plate with a flat inclined surface, an upper piston positioned above said upper wedge for moving said upper wedge in said first direction, means for preventing both said upper wedge and said upper piston from moving in a second direction transverse to said first direction and for permitting movement of said upper wedge and said upper piston only in said first direction, a lower wedge mounted below said upper wedge for movement in said second direction, said lower wedge having a flat inclined surface in sliding contact with said inclined surface of said upper wedge, and said lower wedge having a substantially cylindrical configuration, graphite inlays in said flat inclined surface of said plate of said upper wedge for reducing a friction coefficient of the upper wedge as said flat inclined surface of said upper wedge slides against said flat inclined surface of said lower wedge, an anchorage plate on a front portion of said lower wedge for holding a punch holder, said anchorage plate including a cover plate extending in said transverse direction from an outer edge of said anchorage plate to said upper piston, and return means for returning said lower wedge to an initial position upon release of a force by said upper piston.

2. Lateral punching unit according to claim 1, wherein:

said lower wedge has a longitudinal slot, and said return means includes:

a cross-piece positioned in said longitudinal slot, and a spring having one end held be said cross-piece and having an opposite end engaging said lower wedge to return said lower wedge to said initial position.

3. Lateral punching unit according to claim 1, wherein said support body includes a cylindrical inner portion fitted with bushings having graphite inlays in contact with the lower wedge.

4. Lateral punching unit according to claim 3, wherein said bushings are made of a bronze material.

5. Lateral punching unit according to claim 1, wherein said upper wedge has a substantially inverted U-shape in surrounding relation to said lower wedge and shaped to prevent rotation of said lower wedge about a longitudinal axis thereof.

6. Lateral punching unit according to claim 5, further comprising:

a base plate on which said support body is installed such that the base plate has a greater surface area than said support a body, and wherein:

said anchorage plate slides axially along an internal surface of said base plate, and rotation between said anchorage plate and said internal surface of said base plate is prevented while permitting axial sliding therebetween.

7. Lateral punching unit according to claim 1, wherein said graphite inlays are spaced apart from each other in said flat inclined surface of said plate of said upper wedge.

8. Lateral punching unit according to claim 1, further comprising a base plate on which said support body is installed with the base plate having a greater surface area than said support body, and a lower part of said anchorage plate aligns with a lower surface of said base plate.

9. Lateral punching unit according to claim 8, wherein the base plate includes:

holes for anchoring the support body to the base plate, holes for aligning the support body with the base plate, holes for securing the base plate to a work surface, and a slot for further securing the base plate to the work surface.

10. Lateral punching unit comprising:

a support body including a longitudinal hole in a rear part thereof for holding a proximity detector, an upper wedge mounted on said support body for movement only in a first direction, said upper wedge have a flat inclined surface, said longitudinal hole having a longitudinal axis that intersects said upper wedge such that said proximity detector can detect if return movement of said upper wedge occurs after a punching operation has been performed, an upper piston positioned above said upper wedge for moving said upper wedge in said first direction, means for preventing both said upper wedge and said upper piston from moving in a second direction transverse to said first direction and for permitting movement of said upper wedge and said upper piston only in said first direction, a lower wedge mounted below said upper wedge for movement in said second direction, said lower wedge having a flat inclined surface in sliding contact with said inclined surface of said upper wedge, and said lower wedge having a substantially cylindrical configuration, an anchorage plate on a front portion of said lower wedge for holding a punch holder, and return means for returning said lower wedge to an initial position upon release of a force by said upper piston.

11. Lateral punching unit according to claim 10, wherein:

said lower wedge has a longitudinal slot, and said return means includes:

a cross-piece positioned in said longitudinal slot, and a spring having one end held by said cross-piece and having an opposite end engaging said lower wedge to return said lower wedge to said initial position.

12. Lateral punching unit according to claim 10, wherein said upper wedge has a substantially inverted U-shape in surrounding relation to said lower wedge so as to prevent rotation of said lower wedge about a longitudinal axis thereof.

13. Lateral punching unit according to claim 12, further comprising:

a base plate on which said support body is installed such that the base plate has a greater surface area than said support body, and wherein:

said anchorage plate slides axially along an internal surface of said base plate, and rotation between said anchorage plate and said internal surface of said base plate is prevented while permitting axial sliding therebetween.

14. Lateral punching unit according to claim 10, further comprising graphite inlays in said flat inclined surface of said plate of said upper wedge for reducing a friction coefficient of the upper wedge as said flat inclined surface of said upper wedge slides against said flat inclined surface of said lower wedge, and said graphite inlays are spaced apart from each other in said flat inclined surface of said plate of said upper wedge.

15. Lateral punching unit comprising:

a support body including a longitudinal hole in a rear part thereof for holding a proximity detector, an upper wedge mounted on said support body for movement only in a first direction, said upper wedge have a plate with a flat inclined surface with graphite inlays therein for reducing a friction coefficient of the upper wedge, said longitudinal hole having longitudinal axis that intersects said upper wedge such that said proximity detector can detect if return movement of said upper wedge occurs after a punching operation has been performed, an upper piston positioned above said upper wedge for moving said upper wedge in said first direction, means for preventing both said upper wedge and said upper piston from moving in a second direction transverse to said first direction and for permitting movement of said upper wedge and said upper piston only in said first direction, a lower wedge mounted below said upper wedge for movement in said second direction, said lower wedge having a flat inclined surface in sliding contact with said inclined surface of said upper wedge, and said lower wedge having a substantially cylindrical configuration, said upper wedge having a substantially inverted U-shape in surrounding relation to said lower wedge so as to prevent rotation of said lower wedge along a longitudinal axis thereof, an anchorage plate on a front portion of said lower wedge for holding a punch holder, return means for returning said lower wedge to an initial position upon release of a force by said upper piston, a base plate on which said support body is installed such that the base plate has a greater surface area than said support body, said anchorage plate slides axially along an internal surface of said base plate, and rotation between said anchorage plate and said internal surface of said base plate is prevented while permitting axial sliding therebetween.

16. Lateral punching unit according to claim 15, wherein:

said lower wedge has a longitudinal slot, and said return means includes:

a cross-piece positioned in said longitudinal slot, and a spring having one end held by said cross-piece and having an opposite end engaging said lower wedge to return said lower wedge to said initial position.

17. Lateral punching unit according to claim 15, wherein said graphite inlays are spaced apart from each other in said flat inclined surface of said plate of said upper wedge.

18. Lateral punching unit according to claim 15, wherein said support body includes a cylindrical inner portion fitted with bushings having graphite inlays in contact with the lower wedge.

* * * * *